United States Patent [19]

Weinstein

[11] Patent Number: 4,746,445

[45] Date of Patent: May 24, 1988

[54] PROCESS FOR MANUFACTURING BENTONITE AGGLOMERATES

[75] Inventor: Barry M. Weinstein, Old Bridge, N.J.

[73] Assignee: Colgate-Palmolive Company, New York, N.Y.

[21] Appl. No.: 849,240

[22] Filed: Apr. 7, 1986

Related U.S. Application Data

[60] Continuation of Ser. No. 646,984, Sep. 4, 1984, abandoned, which is a division of Ser. No. 366,587, Apr. 8, 1982, Pat. No. 4,488,972.

[51] Int. Cl.[4] ..... C11D 3/08; C11D 3/12; C22B 1/14; D06M 11/06

[52] U.S. Cl. ..... 252/8.6; 23/313 AS; 252/140; 264/117

[58] Field of Search ..... 23/313 R, 313 AS, 313 P; 264/117; 252/8.6, 131, 135, 140, 174, 174.25

[56] References Cited

U.S. PATENT DOCUMENTS

| | | | |
|---|---|---|---|
| 3,625,902 | 12/1971 | Sumner | 252/99 |
| 3,852,211 | 12/1974 | Ohren | 252/110 |
| 3,915,882 | 10/1975 | Nirschl | 252/8.6 |
| 3,966,629 | 6/1976 | Dumbrell | 252/140 |

FOREIGN PATENT DOCUMENTS

| | | | |
|---|---|---|---|
| 2086402 | 5/1982 | United Kingdom | 252/88 |

*Primary Examiner*—Dennis Albrecht

*Attorney, Agent, or Firm*—B. Lieberman; M. M. Grill

[57] ABSTRACT

Bentonite agglomerates are made which are suitable for use as a particulate fabric softener for softening washed laundry, especially when incorporated in detergent compositions by mixing with spray dried beads containing essential detergent composition components. Such agglomerates are in the No's. 10–100 sieve range and are agglomerates of finely divided bentonite. The agglomerates are of a bulk density in the range of 0.7 to 0.9 g./ml., a moisture content of 8 to 13% and a frangibility less than 30, and include 1 to 5% of a binder (sodium silicate). The described bentonite agglomerates are manufactured by spraying an aqueous solution of the binder onto moving surfaces of finely divided bentonite until the moisture content thereof is elevated and the amount of binder for the agglomerate is sufficient, and drying the agglomerated particles to their "equilibrium moisture range".

The agglomerated particles, which are irregular in shape and craggy of surface, when mixed with spray dried built detergent particles, do not objectionably segregate from them despite different bulk densities and some variations in particle sizes, and it is considered that the irregularity of shape and the cragginess of the agglomerated bentonite bead surfaces help to maintain the uniformity of distribution of the agglomerates in such fabric softening laundry detergent product.

5 Claims, 2 Drawing Sheets

PROCESS FOR MANUFACTURING BENTONITE AGGLOMERATES

This application is a continuation of Ser. No. 646,984, filed Sept. 4, 1984, now abandoned, which is a division of Ser. No. 366,587 filed Apr. 8, 1982 now U.S. Pat. No. 4,488,972.

This invention relates to bentonite agglomerates. More particularly, it relates to agglomerates of a finely divided bentonite powder, useful as softening additives for detergent compositions so that laundry washed with such compositions will be acceptably soft to the touch. The invention also relates to methods for making such agglomerates and to detergent compositions containing them.

Many years ago it was disclosed in the patent art that when bentonite is incorporated in detergent compositions, together with a synthetic detergent and a builder salt, it gives fabrics washed with such compositions a full feel and a soft handle. Bentonite has long been employed in soap and detergent products as a filler and bodying agent and it has been recognized in the detergent industry that fabrics are softened by the deposition of bentonite onto them from aqueous solutions of detergents. Among patents containing such disclosures are British patent specification Nos. 404,413; 461,221; 1,401,726; 1,400,898; 1,455,873; 1,460,616; and 1,572,815; British patent application No. 2,063,283; and U.S. Pat. Nos. 3,594,212; 3,936,537; and 4,141,847. Bentonite powder, in very finely divided form, which is desirable for maximum softening effectiveness and unobtrusiveness on softened fabrics, has been mixed with other particulate components of a detergent composition. In some cases, it has been agglomerated onto the surfaces of spray dried or other manufactured particles containing the rest of the components of the detergent composition. Sometimes such agglomeration has been assisted by the use of aqueous sprays of electrolytes. Bentonite has also been agglomerated into larger beads devoid of significant quantities of other detergent components. Normally, for mixture with detergent composition beads, such bentonite agglomerate particles would be of approximately the same size and density as the detergent beads, to prevent segregation of the different particles and consequent unsatisfactory washing and/or softening of laundry. In some instances the binders employed to make prior art products, often present in relatively large proportions, had imparted to the bentonite agglomerate properties that would make it unsuitable for use with certain types of detergent compositions. In other cases, the agglomerates made were too friable so that ordinary handling of the product by conveyers, feeders, mixers (post-addition apparatuses), filling machinery and normal shipping shocks caused excessive breakdowns of the agglomerates, resulting in less attractive products, which tended to have portions thereof segregated after storage and shipment. The present invention provides a non-segregating product, the particles of which are of improved structural stability, which disperses readily in wash water. The binder employed does not make the bentonite agglomerates made unsuitable for use in detergent compositions; on the contrary, it is very versatile, allowing the agglomerate to be used in a wide variety of detergent composition formulations and at any of various concentrations therein, depending on the effects desired. The present agglomerates are easily manufactured and are readily incorporated, by mixing, with spray dried (or equivalent) products containing essential detergent composition components.

In accordance with the present invention a particulate fabric softener, suitable for incorporation in detergent compositions for softening washed laundry, comprises agglomerates of finely divided bentonite, of particle sizes less than No. 200 sieve, agglomerated to particles of sizes essentially in the No's. 10–100 sieve range, of a bulk density in the range of 0.7 to 0.9 g./ml., a moisture content of 8 to 13% and a frangibility less than 30, and includes about 1 to 5% of a binder to assist in maintaining the integrity of the agglomerates until they are added to water, in which it is intended that they disintegrate and disperse.

The bentonite employed is a colloidal clay (aluminum silicate) containing montmorillonite. Montmorillonite is a hydrated aluminum silicate in which about 1/6th of the aluminum atoms may be replaced with magnesium atoms and with which varying amounts of sodium, potassium, calcium, magnesium and other metals, and hydrogen, may be loosely combined. The type of bentonite clay which is most useful in making the invented agglomerated particles is that which is known as sodium bentonite (or Wyoming or western bentonite), which is normally a light to cream-colored impalpable powder which, in water, forms a colloidal suspension having strongly thixotropic properties. In water the swelling capacity of the clay will usually be in the range of 3 to 15 ml./gram, preferably 7 to 15 ml./g., and its viscosity, at a 6% concentration in water, will usually be in the range of 3 to 30 centipoises, preferably 8 to 30 centipoises. Preferred swelling bentonites of this type are sold under the trademark Mineral Colloid, as industrial bentonites, by Benton Clay Company, an affiliate of Georgia Kaolin Co. These materials which are the same as those formerly sold under the trademark THIXO-JEL, are selectively mined and beneficiated bentonites, and those considered to be most useful are available as Mineral Colloid No's. 101, etc., corresponding to THIXO-JELs No's. 1, 2, 3 and 4. Such materials have pH's (6% concentration in water) in the range of 8 to 9.4, maximum free moisture contents of about 8% and specific gravities of about 2.6, and for the pulverized grade at least about 85% (and preferably 100%) passes through a 200 mesh U.S. Sieve Series sieve. More preferably, the bentonite is one wherein essentially all the particles (over 90%, preferably over 95%) pass through a No. 325 sieve and most preferably all the particles pass through such a sieve. Beneficiated western or Wyoming bentonite is preferred as a component of the present compositions but other bentonites are also useful, especially when they form only a minor proportion of the bentonite used.

Although it is desirable to limit maximum free moisture content, as mentioned, it is even more important to make certain that the bentonite being employed includes enough free moisture, most of which is considered to be present between adjacent plates of the bentonite, to facilitate quick disintegration of the bentonite agglomerate when such particles or detergent compositions containing them are brought into contact with water, such as wash water. It has been found that at least about 2%, preferably at least 3% and more preferably, at least about 4% or more of water should be present in the bentonite initially, before it is agglomerated, and such proportion should also be present after any drying. In other words, overdrying to the point where the bentonite loses its "internal" moisture can significantly diminish the utility of the present compositions. When the bentonite moisture content is too low the bentonite does not satisfactorily aid in disintegrating the agglomerate in the wash water. When the bentonite is of satisfactory moisture content it may have an effective exchangeable calcium oxide percentage in the range of about 1 to 1.8 and with respect to magnesium oxide such percentage will often be in the range of 0.04 to 0.41. Typical chemical analysis of such a material is from 64.8 to 73.0% of $SiO_2$, 14 to 18% of $Al_2O_3$, 1.6 to 2.7% of MgO, 1.3 to 3.1% of CaO, 2.3 to 3.4% of $Fe_2O_3$, 0.8 to 2.8% of $Na_2O$ and 0.4 to 7.0% of $K_2O$.

Instead of utilizing the THIXO-JEL or Mineral Colloid bentonites one may also employ equivalent competitive products, such as that sold by Americal Colloid Company, Industrial Division, as General Purpose Bentonite Powder, 325 mesh, which has a mininum of 95% thereof finer than 325 mesh or 44 microns in diameter (wet particle size) and a minimum of 96% finer than 200 mesh or 74 microns diameter (dry particle size). Such a hydrous aluminum silicate is comprised principally of montmorillonite (90% minimum), with smaller proportions of feldspar, biotite and selenite. A typical analysis, on an "anhydrous" basis, is 63.0% silica, 21.5% alumina, 3.3% ferric iron (as $Fe_2O_3$), 0.4% of ferrous iron (as FeO), 2.7% of magnesium (as MgO), 2.6% of sodium and potassium (as $Na_2O$), 0.7% of calcium (as CaO), 5.6% of crystal water (as $H_2O$) and 0.7% of trace elements.

Although the western bentonites are preferred it is also possible to utilize synthetic bentonites, such as those which may be made by treating Italian or similar bentonites containing relatively small proportions of exchangeable monovalent metals (sodium and potassium) with alkaline materials, such as sodium carbonate, to increase the calcium ion exchange capacities of such products. Analysis of a typical Italian bentonite after alkali treatment indicates that it contains 66.2% of $SiO_2$, 17.9% $Al_2O_3$, 2.80% of MgO, 2.43% of $Na_2O$, 1.26% of $Fe_2O_3$, 1.15% of CaO, 0.14 of $TiO_2$ and 0.13% of $K_2O$, on a dry basis. It is considered that the $Na_2O$ content of the bentonite should be at least about 0.5%, preferably at least 1% and more preferably at least 2% (with the equivalent proportion of $K_2O$ also taken into account), so that the clay will be satisfactorily swelling, with good softening and dispersing properties in aqueous suspension, to accomplish the purposes of the present invention. Preferred swelling bentonites of the synthetic types described are sold under the trade names Laviosa and Winkelmann, e.g., Laviosa AGB and Winkelmann G 13.

The silicate, which is employed as a binder to hold together the finely divided bentonite particles in agglomerated form, it preferably a sodium silicate of $Na_2O:SiO_2$ ratio of 1:1.6 to 1:3.2, preferably 1:2, to 1:2.8 or 1:3.0, e.g., 1:2.35 or 1:2.4. The silicate is water soluble and solutions thereof at the concentrations employed in this invention, which may be as high as up to about 50%. are free flowing, especially at elevated temperatures to which the silicate spray is preferably heated.

The water employed is preferably of low hardness and inorganic salt contents but ordinary city waters may be used. Usually the hardness contents of such waters will be less than 300 p.p.m., as calcium carbonate, preferably less than 150 p.p.m., as $CaCO_3$.

The agglomerating spray may also contain other components, especially minor adjuvants, which may desirably be incorporated with the bentonite agglomerates. For example, in some instances dyes and/or pigments, such as Polar Brilliant Blue and ultramarine blue, respectively, may be employed, either dissolved or dispersed in the spray liquid. Other components thereof that may sometimes be used include nonionic detergents, fluoroscent brighteners, perfume, antibacterial compounds, sequestrants and binders other than silicates. Among such other binders that sometimes are useful may be mentioned organic binders, such as gums, e.g., sodium alginate, carrageenan, sodium carboxymethylcellulose and carob bean gum, gelatin, resins, such as polyvinyl alcohol and polyvinyl acetate, and suitable water soluble salts.

The finely powdered bentonite employed, of particle sizes less than No. 200 sieve, preferably with essentially, all (over 90%) of the particles thereof passing through a No. 325 sieve, and more preferably will all such particles passing through such sieve, is agglomerated by being tumbled in an agglomerating apparatus, such as an inclined drum, equipped with a number of breaker bars, so that the particles are in continuous movement and form a falling "screen" onto which a spray of agglomerating liquid may be directed. The finely powdered bentonite particles are preferably of a normal particle size distribution before agglomeration and the agglomerates are similarly usually of such normal distribution within their particular size ranges. After agglomeration the particles will be of sizes essentially in the No's. 10–100 sieve range (U.S. Sieve Series), although occasionally particles as large as No's. 6 and 8 may be present. The preferred size range for the agglomerates is 30–100, more preferably 40–100 or 40–80. While particles of various shapes may be made, those which appear to be most satisfactory are irregular in shape and craggy or rough in appearance, with indentations or openings in the surfaces thereof. Such "cragginess" appears to assist the particles in maintaining uniformly distributed positions in detergent compositions, when they are dispersed in a "matrix" of spray dried detergent composition globules or beads, despite the fact that such spray dried detergent may be of much lower bulk density, smooth surfaced and globular. The irregularity of the agglomerate particles, most of which appear to be somewhat oblong, may be expressed as an average (weight average) ratio of the longest dimension of a particle to its shortest dimension transverse to the longitudinal axis. Normally, such ratio, which may be termed the "average irregularity" of the particles, is between 1.2 and 2, with most particles having such a ratio in the range of 1.2 to 1.5, e.g., 1.3. The bulk density of such particles will be within the 0.7 to 0.9 g./ml. range, preferably being within the range of 0.75 to 0.9 g./ml., e.g., 0.8 g./ml. The roughness or cragginess of the particles, which differ markedly from the normal spray dried particles in such respect, (because the spray dried particles usually are smoother surfaced and more spherical in shape), result in surface indentations or wells which may fit the smoother more spherical spray dried particles and inhibit relative segregating or settling movement and respect to them.

The nature of the agglomerated particles of this invention is readily understood by reference to the drawing, in which.

Figure 1:
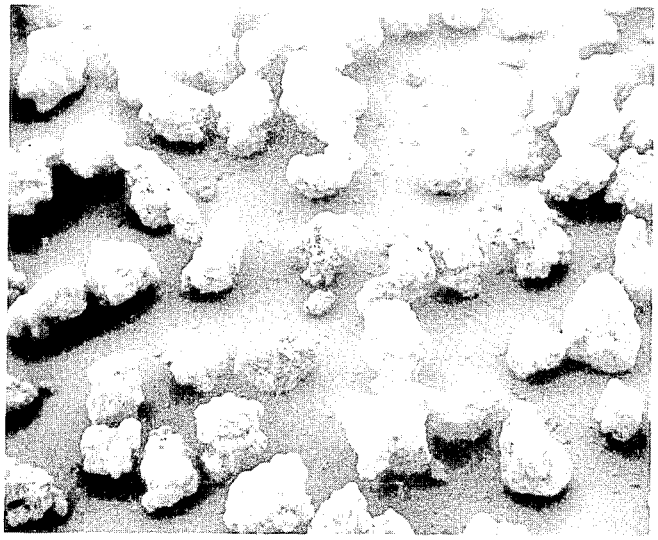
FIG. 1 is a microphotograph of a number of agglomerated bentonite particles of the product of this invention, magnified twenty times.
Figure 2:
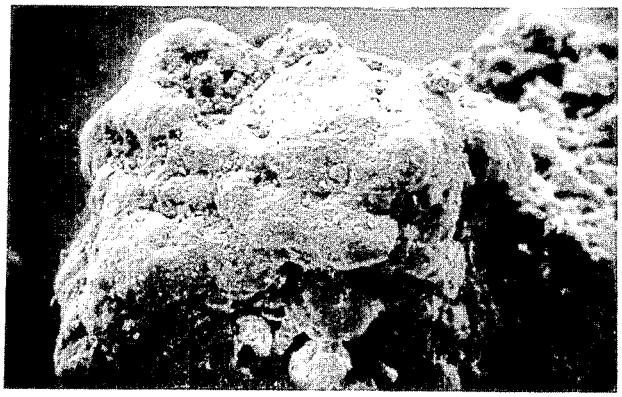
FIG. 2 is a microphotograph of one such particle, magnified 200 times.
Figure 3:
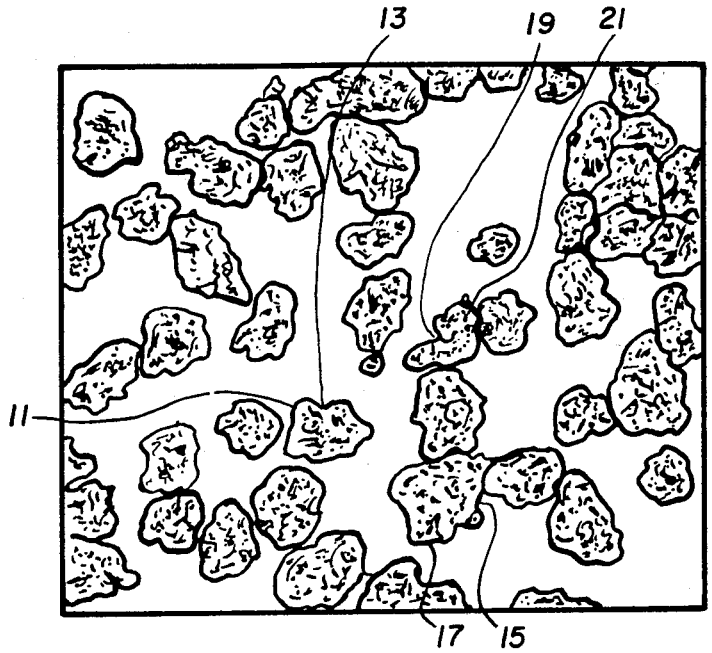
FIG. 3 is a drawing corresponding to FIG. 1.
Figure 4:
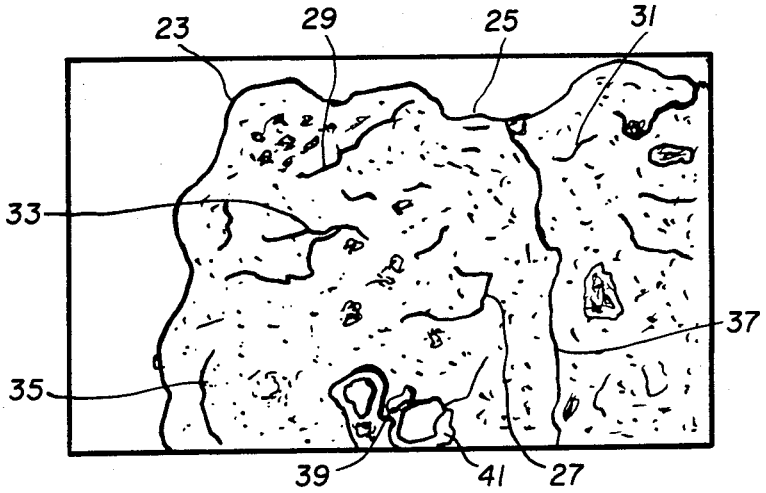
FIG. 4 is a drawing corresponding to FIG. 2.

In FIG. 3 numeral 11 designated what may be considered a typical agglomerated particle having an indentation 13 on a side thereof. Similarly, indentation 15 is on a side of particle 17 and indentation 19 is on a side of particle 21. All such particles, as seen from the microphotograph of FIG. 1, are rough surfaced, which, together with the indentations that can conform to the curvatures of the spray dried detergent beads, can help to keep the particles from moving with respect to the beads. The indentations appear to be of depths of at least 1.5%, e.g., 0.5 to 2% of the particle diameter, and there seem to be at least 100, perhaps 100 to 500 of such indentations per particle. In FIG. 4 surface characteristics of one agglomerated bead are illustrated in greater detail. As is seen from the figure, agglomerate particle 23 includes a surface indentation 25 and many fissures, such as those identified by numerals 27, 29, 31, 33, 35 and 37. Also, some larger openings such as that identified by numeral 41 seem to contain smaller agglomerated particles, like that designated by numeral 39.

The agglomerated bentonite particles include about 1 to 5% of a binder, such as the sodium silicate previously described (although sometimes other binders may be employed, especially in mixture with the sodium silicate), preferably 2 to 4%, e.g., 3%. Due to the method of manufacture, the concentration of the binder is greater at the surface of the agglomerate than in the interior, with such difference often being from 5 to 50% greater, e.g., 2.8% in the interior and 3.4% on the surface. Such increased concentration of the binder at the surface is desirable because it tends to prevent excess dusting and disintegration of the surface portion of the agglomerate and yet, once the bentonite particles are placed in the wash water and the surface silicate coating is breached, the particles disintegrate rapidly to their original unagglomerated size, and smaller, and disperse in the water.

The moisture content of the bentonite agglomerate particles should be within a relatively narrow range for best properties. Thus, the moisture content will be about or somewhat greater than the "equilibrium moisture content" of bentonite, 8 to 13%, preferably 11 to 13%, e.g., 12%.

The agglomerated bentonite particles are not excessively friable or frangible and when subjected to a severe frangibility test are shown to be significantly less frangible than ordinary spray dried detergent composition beads. The frangibility will be less than 30, preferably less than 25, and often will be in the range of 20 to 25, e.g., about 23 (percent). The test for frangibility employed is an empirical one wherein 100 grams of product to be tested are placed on a No. 100 screen (U.S. Standard Sieve) with three rubber balls and the screen is shaken for thirty minutes. After completion of the shaking, using a mechanical shaking device, the material passing through the screen during the thirty minute period is then weighed and the number of grams corresponds to the frangibility number. The balls employed are pure gum rubber, 3.5 cm. in diameter and each weigh 27 grams. The sieve shaker is a Ro-Tap Testing Sieve Shaker, manufactured by W.S. Tyler Company, Cleveland, Ohio. The frangibility number of a standard (and normally acceptable) commercial spray dried synthetic organic detergent composition is 34.

Although the bentonite particles may contain only bentonite, binder and water, in some instances it may be desirable to include other materials in the particles, as was previously mentioned. Normally such will not constitute more than 5% of the particles, e.g., 0.01 to 3% and when the only such material is a dye, and/or pigment, the concentration thereof will usually be from 0.1 to 1%, preferably 0.05 to 0.5%. While it is possible to add such coloring material or other adjuvant only toward the end of the agglomerating procedure, so that the colorant appears only on the surfaces of the agglomerates, usually it will be preferred that the colorant, such as a bluing agent, be distributed throughout the agglomerate particle, so that if the particle is fractured, it will still appear to be colored. When particles are not colored and contain only bentonite, binder and water, they may appear to be off-white, due to the bentonite powder containing off-color components or impurities. When such uncolored agglomerated bentonite particles are viewed alone they appear to be noticeably off-white, compared to spray dried detergent beads. Yet, when mixed with such spray dried detergent beads, even at significant concentrations, such as from 10 to 30%, e.g., 20%, the product does not appear to be off-color and the bentonite agglomerate particles do not stand out from the spray dried detergent beads. It has been theorized that such "blending in" of the bentonite agglomerate particles may be due to their craggy surface and to their indentations conforming with the surfaces of the spray dried beads, filling the interstices between such beads and thereby being obscured.

The bentonite agglomerates are made by spraying an aqueous solution of a binder onto the moving surfaces of the finely divided bentonite and keeping the finely divided bentonite and the resulting agglomerating particles in motion until a major proportion of the particles is agglomerated so as to be within the No's. 10–100 sieve range. When that happens the moisture content of the agglomerate will usually be in the range of 20 to 35% and the binder content will be about 1 to 5%, when the aqueous spray solution employed is at a concentration of 2 to 20%. Preferably the binder content of the spray will be from 4 to 10%, more preferably 6 to 9%, e.g., 7 or 7.5%, and the moisture content of the agglomerated particles, before drying, will be 23 to 31%, e.g., 27%. The spray will normally be at an elevated temperature when it is sprayed onto the finely divided bentonite powder, which temperature will usually be in the range of 65° to 85° C., preferably 65° to 75° C., e.g., about 70° C. The spray will be in finely divided droplet form, preferably generated by a spray nozzle designed to produce a flat spray pattern, which spray is designed to produce a flat spray pattern, which spray is directed transversely with respect to a screen of particles in the agglomerator. The spray nozzle will preferably be of an orifice diameter in the range of 0.05 to 0.1 mm., the spray will be directed at an angle between 40° and 120° and across a falling stream of particles to be agglomerated, and spraying will be at a pressure in the range of 0.5 to 20 kg./sq. cm., preferably 1 to 6 kg./sq. cm.

Although various apparatuses may be used for the agglomeration, that which is most preferred is an O'-Brien agglomerator, in which an inclined drum, equipped with a plurality of breaker bars, is so constructed as to produce a screen of particles onto which the spray impinges. The O'Brien agglomerator may be operated on a batch or continuous basis and may be subject to automatic control with respect to feeds, sprays, removal rates and agglomerate particle sizes. Normally the agglomeration period will be that which is just sufficient to produce particles of the desired sizes, e.g., No's. 10–100 sieve size, but in some cases additional tumbling may be utilized after completion of spraying of the agglomerating liquid. However, spraying will not be continued so long as to destroy the craggy nature of the particle surfaces. Usually the residence time in the agglomerator, whether operated continuously or as a batch, will be within the range of 10 to 40 minutes, preferably 15 to 30 minutes, e.g., 22 minutes, but residence time depends on the design and size of the agglomerator and the speed of rotation or other movement thereof, which speed normally will be from 3 to 40 r.p.m., preferably 6 to 20 r.p.m.

After completion of agglomeration the moist agglomerate is next dried. Some evaporation of moisture may occur during agglomeration but it is only a fraction of that required to lower the moisture content to the desired range. Various types of dryers may be employed but it is preferred to utilized a fluid bed type dryer. In such a small scale dryer, with an air temperature of 65° C. and a flow rate of about 7,000 liters per minute, two kilograms of "wet" agglomerate are dried to a moisture content in the range of 8 to 13% in from five to ten minutes. For larger charges of the agglomerate the air flow rate is preferably increased accordingly, so that the drying will take about the same period of time, although times within the range of 3 to 30 minutes are also acceptable. During such times the mass flow rate of moisture to the surface of the agglomerate causes migration in internal silicate to the surface, thereby increasing the surface concentration thereof and better strengthening the agglomerated particles resulting. Of course, when the size of the charge and the production rate outstrip the equipment design, larger dryers will be employed.

The fabric softening bentonite agglomerates may be used alone for their softening function or may be employed in conjunction with soaps and/or synthetic organic detergents, preferably built detergents. However, the most preferred application of these products is in mixture with particulate synthetic organic detergent compositions, in which the bentonite agglomerates provide a fabric softening component. Still, it is within the invention to utilize the agglomerates in other ways for fabric softening, as by adding the agglomerated product to rinse water or to wash water. When mixed with and thereby incorporated in a synthetic organic detergent composition the present non-segregating softening agent is useful together with a wide variety of synthetic organic detergent products, including those made by spray drying, agglomeration, or other manufacturing techniques, and wherein particle sizes may vary over a wide range, e.g., No's. 6–140 sieve, but normally the detergent composition component of these combined products will be of particle sizes in the No's. 10–100 range. Similarly, a wide variation in bulk density of the detergent may be tolerated, from 0.2 to 0.9 g./ml. but normally the bulk density will be in the range of 0.2 to 0.6, often 0.2 to 0.4 g./ml., and the product will be spray dried.

The essential components of the built synthetic organic detergent beads include a synthetic organic detergent, which may be an anionic detergent, nonionic detergent, or a mixture thereof, a builder or mixture of builders, and moisture, although in many instances various adjuvants may also be present. In some cases, as when building is not considered to be necessary, the builder may be replaced by a filler, such as sodium sulfate or sodium chloride, or a mixture thereof.

Various anionic detergents, usually as sodium salts, may be employed but those which are most preferred are linear higher alkyl benzene sulfonates, higher alkyl sulfates and higher fatty alcohol polyethoxylate sulfates. Preferably, in the higher alkyl benzene sulfonate the higher alkyl is linear and of 12 to 15 carbon atoms, e.g., 13, and is a sodium salt. The alkyl sulfate is preferably a higher fatty alkyl sulfate of 10 to 18 carbon atoms, preferably 12 to 16 carbon atoms, e.g., 12, and is also employed as the sodium salt. The higher alkyl ethoxamer sulfates will similarly be of 10 or 12 to 18 carbon atoms, e.g., 12, in the higher alkyl, which will preferably be a fatty alkyl, and the ethoxy content will normally be from 3 to 30 ethoxy groups per mol, preferably 3 or 5 to 20. Again, the sodium salts are preferred. Thus, it will be seen that the alkyls are preferably linear or fatty higher alkyls of 10 to 18 carbon atoms, the cation is preferably sodium, and when a polyethoxy chain is present the sulfate is at the end thereof. Other useful anionic detergents of this sulfonate and sulfate group include the higher olefin sulfonates and paraffin sulfonates, e.g., the sodium salts wherein the olefin or paraffin groups are of 10 to 18 carbon atoms. Specific examples of the preferred detergents are sodium tridecyl benzene sulfonate, sodium tallow alcohol polyethoxy (3 EtO) sulfate, and sodium hydrogenated tallow alcohol sulfate. In addition to the preferred anionic detergents mentioned, others of this well known group may also be present, especially in only minor proportions with respect to those previously described. Also, mixtures thereof may be employed and in some cases such mixtures can be superior to single detergents. The various anionic detergents are well known in the art and are described at length at pages 25 to 138 of the text *Surface Active Agents and Detergents,* Vol. II, by Schwartz, Perry and Berch, published in 1958 by Interscience Publishers, Inc.

Small proportions of fatty acid soaps, e.g., sodium soaps of fatty acids of 10 to 24 carbon atoms, preferably 14 to 18 carbon atoms, e.g., sodium hydrogenated tallow fatty acids soaps, can be employed, in the crutcher or post-added, as foam controllers, when less foam in the washing machine is desirable.

Although various nonionic detergents of satisfactory physical characteristics may be utilized, including condensation products of ethylene oxide and propylene oxide with each other and with hydroxyl-containing bases, such as nonyl phenol and Oxo-type alcohols, it is highly preferred that the nonionic detergent be a condensation product of ethylene oxide and higher fatty alcohol. In such products the higher fatty alcohol is of 10 to 20 carbon atoms, preferably 12 to 16 carbon atoms, and the nonionic detergent contains from about 3 to 20 or 30 ethylene oxide groups per mol, preferably from 6 to 12. Most preferably, the nonionic detergent will be one in which the higher fatty alcohol is of about 12 to 13 or 15 carbon atoms and which contains from 6 to 7 or 11 mols of ethylene oxide. Such detergents are made by Shell Chemical Company and are available under the trade names Neodol® 23-6.5 and 25-7. Among their specially attractive properties, in addition to good detergency with respect to oily stains on goods to be washed, is a comparatively low melting point, yet appreciably above room temperature, so that they may be sprayed onto base beads as a liquid which solidifies.

The water soluble builder employed may be one or more of the conventional materials that have been used as builders or suggested for such purpose. These include inorganic and organic builders, and mixtures thereof. Among the inorganic builders those of preference are the various phosphates, preferably polyphosphates, e.g., tripolyphosphates and pyrophosphates, such as pentasodium tripolyphosphate and tetrasodium pyrophosphate. Trisodium nitrilotriacetate (NTA), preferably employed as the monohydrate, and other nitrilotriacetates, such as disodium nitrilotriacetate are also useful water soluble builders. Sodium tripolyphosphate, sodium pyrophosphate and NTA are preferably present in hydrated forms. Of course, carbonates, such as sodium carbonate, are useful builders and may desirably be employed, alone or in conjunction with bicarbonates, such as sodium bicarbonate. Other water soluble builders that are considered to be effective include the various other inorganic and organic phosphates, borates, e.g., borax, citrates, gluconates, EDTA and iminodiacetates. Preferably the various builders will be in the forms of their alkali metal salts, either the sodium or potassium salt, or a mixture thereof, but sodium salts are normally more preferred.

Sodium silicates, of the type previously described in conjunction with the description of the binders, serve as builder salts and as binders in the detergent composition beads. The proportions of such materials in the spray dried beads are included within the given ranges of percentages of builder present in such beads. Sodium silicate also contributes anti-corrosion properties to the detergent composition, which is especially important when the detergent solution is to be employed in washing machines in contact with aluminum parts thereof. It is also within the present invention for a proportion of the sodium silicate of the detergent composition to be post-added as hydrous sodium silicate.

In addition to the water soluble builders mentioned one may also employ water insoluble builders, such as the zeolites. These materials normally will be of the formula $$(Na_2O)_x.(Al_2O_3)y.(SiO_2)_z.w\ H_2O$$

wherein x is 1, y is from 0.8 to 1.2, preferably about 1, z is from 1.5 to 3.5, preferably 2 to 3 or about 2, and w is from 0 to 9, preferably 2.5 to 6.

The zeolite should be a univalent cation-exchanging zeolite, i.e., it should be an aluminosilicate of a univalent cation such as sodium, potassium, lithium (when practicable) or other alkali metal, ammonium or hydrogen (sometimes). Preferably the univalent cation of the zeolite molecular sieve is an alkali metal, especially sodium or potassium, and most preferably it is sodium.

Crystalline types of zeolites of good calcium ion exchange properties, preferably over 200 milligram equivalents of $CaCO_3$ per gram, and utilizable as effective exchangers in the invention, at least in part, include zeolites of the following crystal structure groups: A, X, Y, L, mordenite and erionite, of which types A, X and Y are preferred. Mixtures of such molecular sieve zeolites can also be useful, especially when type A zeolite is present. These crystalline types of zeolites are well known in the art and are more particularly described in the text *Zeolite Molecular Sieves,* by Donald W. Breck, published in 1974 by John Wiley & Sons. Typical commercially available zeolites of the aforementioned structural types are listed in Table. 9.6 at pages 747–749 of the Breck text. Suitable such zeolites, including amorphous zeolites, have been described in many patents in recent years for use as detergent composition builders. The most preferred zeolites are of type A, which is described in U.S. Pat. No. 2,882,243. Zeolite 4A has a pore size of about 4 Angstroms and normally will be hydrated to the extent of 5 to 30%, preferably 15 to 25%, e.g., of 20%, moisture content.

Various adjuvants may be present in the crutcher mix from which detergent compositions may be spray dried, or such adjuvants may be post-added, with the decision as to the mode of addition often being determined by the physical properties of the adjuvant, its resistance to heat, its resistance to degradation in the aqueous crutcher medium, and its volatility. Although some adjuvants, such as fluorescent brightener, pigment, e.g., ultramarine blue, titanium dioxide, and inorganic filler salt may be added in the crutcher, others, such as perfumes, enzymes, bleaches, some colorants, bactericides, fungicides, and flow promoting agents may often be sprayed onto or otherwise mixed with the base beads or spray dried detergent composition with any nonionic detergent to be added, and/or independently, so that they will not be adversely affected by the elevated temperatures of the spray drying operation, and also so that their presence in the spray dried beads does not inhibit absorption of nonionic detergent, when such is to be post-sprayed onto the beads. However, for stable and normally solid adjuvants, mixing with the starting slurry in the crutcher is usually feasible. Thus, it is contemplated that pigments and fluoroscent brighteners, when employed, will normally be present in the crutcher mix from which the present base beads are sprayed.

Although various proportions of components may be employed to make the synthetic organic detergent composition, preferably 5 to 30 parts of the synthetic organic detergent is present with 20 to 70 parts of a builder and 8 to 15 parts of moisture in the product and such composition will be in spray dried form. Of course, mixtures of various components are intended to be included within the terms "detergent", and "builder". Preferred proportions are 12 to 25 parts of an anionic sulfonate or sulfate detergent or mixture thereof, 20 to 40 parts of phosphate builder salt, 5 to 12 parts of water soluble silicate and 5 to 25 parts of sodium carbonate, with 8 to 13 parts of moisture. More preferably, the composition comprises 15 to 22 parts of sodium linear triecylbenzene sulfonate, 20 to 30 parts of pentasodium tripolyphosphate, 6 to 11 parts of sodium silicate of $Na_2O:SiO_2$ ratio in the range of 1:2 to 1:3, 10 to 20 parts of sodium carbonate and 8 to 11 or 13 parts of moisture. The numerals given for the various parts may be converted to percentages for the final product, containing bentonite agglomerate. Also, they may be converted to percentages for the spray dried detergent beads by multiplying by 1.27 or by (one hundred divided by the percent of post-added materials in the final product).

While the detergent compositions based on anionic detergent and phosphate builder salt are considered to be especially satisfactory for use with the bentonite agglomerates of this invention, one may also employ non-phosphate detergent compositions and those based on nonionic detergents or on mixtures of nonionic and anionic detergents. In such cases normally only a limited proportion of nonionic detergent, up to 5% and preferably up to 2 or 3%, will be in the spray dried beans and in some cases none of it will be spray dried. The balance of the nonionic detergent may be post-sprayed onto the spray dried beads. Normally, unless a substantial proportion, e.g., one-half or more of the builder, is a zeolite or absorbent phosphate or carbonate, only a limited total proportion of nonionic detergent will be present in the detergent composition, for example, from 2 to 15%, on a spray dried product basis, but when more absorptive builders, such as those mentioned, are present, as much as 25% of the nonionic detergent may be employed. Usually, the nonionic detergent will be sprayed onto the base beads as a readily solidifiable melt, to promote quick absorption.

The present detergent composition (without the bentonite agglomerate particles) may be produced by agglomeration techniques, somewhat like those described herein for agglomerating the bentonite powder, but it is highly preferred that it be made by spray drying. Spray drying techniques are well known and will not be described at length here. Suffice it to say that an aqueous crutcher mix of the various components of the intended product (except bentonite agglomerate and other post-additives) will be made, containing from about 40 to about 70 or 75% of solids (non-aqueous materials), preferably 50 to 65%, with the balance being water. In the making of the crutcher mix it will be preferred to add the silicate last. In some instances it may be considered desirable to employ bentonite and/or anti-setting agents, such as citric acid and magnesium sulfate, in the crutcher mix, although normally such additions will not be either desirable or necessary. When anti-setting agents are employed they should be added early in the admixing operation and before any combination of silicate and carbonate is present. If bentonite is to be added, usually in only small proportion, it will normally be near the end of the admixings, to avoid excessive volume increases and aeration as mixing is continued. The crutcher temperature will normally be in the 20° to 80° C. range, preferably being from 4° to 70° C. Crutching times may be as little as ten minutes but can take up to an hour, although thirty minutes is a preferable upper limit. The crutched slurry is dropped from the bottom of the crutcher to a positive displacement pump, which forces it at high pressure through spray nozzles at the top of a conventional spray tower (countercurrent or concurrent) wherein the droplets of slurry fall through a hot drying gas. The drying gas temperature will normally be within the range of 200° to 400° C. The warm, spray dried product is removed from the bottom of the tower and is screened, if required, to desired size, e.g., No's. 10 to 60 or 100, or 40 to 100 sieve. After cooling, and sometimes before, it is ready for application of nonionic detergent, if desirable, which application is effected normally by spraying the detergent onto a moving bed of the spray dried beads in a tumbling drum. Any other adjuvants to be post-added, such as enzymes, and bleaching agents, may also be applied in the tumbling drum or after absorption of the nonionic detergent. Similarly, post-added materials may be tumbled in with the spray dried beads when nonionic detergent is not post-sprayed. Perfumes may be added during the tumbling operation or may be added subsequently to the mixing of the bentonite agglomerate particles with the spray dried detergent beads.

Mixing together of the detergent composition particles and the bentonite agglomerate particles may be effected in any suitable type of mixer, such as a Day mixer, a Lödige mixer or a V- or twin shell blender. Preferably, mixing will be gentle and at low mixer speed, e.g., 5–50 r.p.m. of the mixer or the mixing element. Tumbling mixers are preferred over blade and ribbon mixers but low speed operation of such less preferable mixers is practicable. Mixing times will normally be comparatively short, to avoid fracturing the particles being mixed, and such times can be from 30 seconds to ten minutes, e.g., 1 to 5 minutes. The proportions of detergent composition particles and agglomerated bentonite particles will normally be such that the agglomerate constitutes about 5 to 30%, preferably 15 to 25% and more preferably about 20% of the final product. Such percentages are found to result in good cleaning and softening of laundry washed with the composition. Also, when the bentonite agglomerates are uncolored they are off-color, and such off-color is not readily apparent at such concentrations and with the described particle sizes. Incidentally, when the particle sizes of the bentonite agglomerates are smaller than those of the detergent beads, such as in the No's. 40–100 range, the break-up of the agglomerate is desirably rapid in water and no deposits appear on the treated laundry. Additionally, despite differences in bulk density and particle shapes (and maybe to some extent because of such particle shapes and structures), the bentonite agglomerates do not segregate objectionably from the matrix particles. Thus, during the use of a box of detergent its composition with respect to bentonite content is substantially unchanged and washing and softening effects are consistently satisfactory.

The final detergent composition of this invention is an excellent built synthetic organic detergent product of satisfactory fabric softening properties, due to the presence of the bentonite agglomerate therein. The agglomerate, although only physically mixed with the spray dried detergent composition beads, and of different density, shape and sometimes sizes, does not segregate from the base particles during normal handling, storage and shipping. When tested for segregation by being subjected to shaking in a Riddle shaker, analyses for bentonite in the top, middle and bottom thirds of the box in which the detergent composition is packed show little variation, all being within 0.5% of the average such concentration, for a specimen with an average bentonite concentration of 18.9%. At the moisture contents mentioned the products are non-caking, non-dusting, free flowing and not excessively frangible. When the bentonite is uncolored the product does not appear to have an off-color component and the product does not appear to be tan or gray, despite the off-color appearance of a mass of bentonite agglomerate particles alone. In summary, the products of this invention, including the agglomerates and the final detergent compositions, exhibit unexpectedly beneficial properties, the agglomerates are exceptionally good softening additives for detergent compositions of various types, and the final products are very satisfactory built fabric softening synthetic organic detergent compositions. Processwise, the agglomeration method is one which can be carried out with relatively unsophisticated equipment, although use of the O'Brien agglomerator is preferred. In locations where spray tower capacity is at a premium the post-addition of the bentonite increases such capacity, in effect. Also, post-addition of the agglomerate is very easily effected, it may be stored for relatively long periods of time before and after mixing with detergent due to the fact that the bentonite moisture content is at about its equilibrium percentage, and detergents of any of various softening capabilities may be made from the same or different spray dried beads, as desired. Thus, the present method allows for formulation versatility and in effect, increases plant capacity.

The following examples illustrate but do not limit the invention. Unless otherwise mentioned, in these examples and in the specification of all parts and percentages are by weight and all temperatures are in °C.

EXAMPLE 1

91 Kilograms of western bentonite (Mineral Colloid 101) of particle sizes that pass through No. 325 sieve are charged into an O'Brien agglomerator of a type illustrated in U.S. Pat. No. 3,625,902. The charge of bentonite powder covers the interior cage of the O'Brien agglomerator to a depth of about 10 cm. An aqueous agglomerating solution containing 7% of sodium silicate of $Na_2O:SiO_2$ ratio of about 1:2.4 is used as the agglomerating liquid spray. In some modifications of the agglomerating process 1% of Polar Brilliant Blue dye is also dissolved in the agglomerating liquid. The aqueous solution is heated to 66° C. and is sprayed through a fluid nozzle under a pressure of 1.4 to 5 kg./sq. cm. Spraying is halted when 34 kg. of the agglomerating solution have been applied to the falling screen of bentonite powder. Such application takes about thirty minutes, with the spray being through a Unijet type T nozzle having a flat spray tip, which nozzle delivers an essentially flat spray across the width of the falling screen of bentonite. Spray times may be varied depending on which nozzle is employed but normally will be from 2 to 60 minutes. The nozzle used is one of equivalent orifice diameter of about 0.9 mm. and sprays at an angle of about 98°, delivering about 0.5 to 1 kg./minute. It is identified as a 110° (nominal) nozzle with a No. 11002 tip. In some cases, a plurality of nozzles, two or three, may be employed to speed the application of the agglomerating liquid and in such situations the sprays would be separately directed at different heights on the falling screen of particles.

During the spraying the rotational speed of the mixer is varied from 20 r.p.m. at the beginning to 6 r.p.m. near the end of the spraying, which helps to maintain a good curtain of bentonite falling inside the drum. Such curtain may be maintained, when the O'Brien agglomerator employed is operated continuously, by varying the cage bar or breaker bar spacing along the drum length.

After completion of the spraying of the liquid onto the bentonite powder operation of the O'Brien agglomerator may be continued for several minutes but preferably the agglomerated product is removed immediately for drying. The particles should be of rough or craggy appearance, like that of the drawing, and if the surfaces are smooth, it is usually a sign that mixing has been continued too long. The wet agglomerates contain about 31% of moisture (the percentage removed to constant weight by heating at 105° C., over a period which is usually kept to no more than five minutes).

The moist agglomerates are next dried in a fluid bed type dryer, with a two kilogram sample being dried for 6 to 7 minutes at 65° C. at an air flow rate of about 7,000 to 14,000 liters per minutes. Moisture is reduced to 12% and the dried agglomerates are of particle sizes within the No's. 10–100 sieve range, with less than 1% thereof below No. 100. (All sieve sizes herein are in the U.S. Sieve Series). Such undersize (and any oversize) material may be removed by sieving. In instances when the agglomerates are of larger sizes than desired they are size reduced, preferably by use of a Stokes granulator, to desired particle size range, e.g., No's. 40–100 or 40–80, and particles outside the desired ranges may be removed by sieving or other classifying method. Size reduced particles may be used without further processing and those undersized may be recycled.

The particles made are of a bulk density of about 0.7 g./ml. and a frangibility well below that of many corresponding commercial detergent composition products of similar particle size. Such frangibility is about 23 and sometimes may be as low as 13. The agglomerated particles are free flowing, non-caking and non-dusting and resist powdering during handling. They are excellent softeners for fabrics and disperse readily to very small ultimate particle sizes, leaving no readily discernible residue on washed materials.

EXAMPLE 2

A spray dried detergent composition product is made by making an aqueous crutcher mix containing about 55% of solids and spray drying such mix to produce a "base bead" containing 22.9% of sodium linear tridecylbenzene sulfonate, 32.1% of sodium tripolyphosphate, 11.7% of sodium silicate ($Na_2O:SiO_2$=1:2.4), 19.5% of sodium carbonate, 0.1% of fluorescent brightener (Tinopal 5BM) and 0.1% of borax, with 13.6% of moisture present. Such spray dried beads, of particle sizes in the No's. 10–100 range and 0.3 g./ml. bulk density, are made by the method described in the specification, utilizing a countercurrent spray drying tower. After cooling to about room temperature 78.46 parts thereof are blended with 20 parts of the agglomerated bentonite particles of Example 1 and 1.14 parts of sodium hydrogenated tallow fatty acid soap, in thin chopped spagetti form, after which 0.2 part of Neodol 25-6.5 (nonionic detergent) and 0.2 part of lemon perfume are sprayed onto the mixture. The mixing and spraying may be effected in any mixer but preferably one of the twin shell blender type or an inclined drum is employed.

The product made is an excellent free flowing, non-dusting, non-caking detergent composition with effective fabric softening properties. When no dye is employed in the bentonite agglomerate the particles thereof appear gray alone but when mixed with the detergent composition particles the off-color of the bentonite is not apparent and the mixture does not look to be any darker or worse in color than the spray dried detergent composition material alone. Suprisingly, although the density of the bentonite agglomerate is about 0.8 and that of the spray dried beads is about 0.3, they do not segregate objectionably on storage and analyses of different portions of a box of the final product, after shaking ten minutes in a Riddle shaker, shows little variation in bentonite content in the product at different heights in the box. When tested for caking the blended material is only slightly to moderately caking, even after storage for almost a week in a 38° C./80% relative humidity oven, which result is satisfactory. It is considered that this good result is due in part to the lack of mass transfer of moisture between the particles of bentonite agglomerate and spray dried detergent and to the fact that the bentonite is at approximately its "equilibrium moisture content".

EXAMPLE 3

When other sodium bentonites, with good swelling capacities and calcium ion exchange properties like those of Mineral Colloid 101 are employed in substitution for it, either in whole or in part (e.g., 50%), similar agglomerated products are obtainable. Thus, when the Mineral Colloid products corresponding to THIXO- JEL's No's. 2, 3 and 4 are substituted for Mineral Colloid 101 or when Laviosa AGB bentonite or Winkelman G 13 bentonite is used instead, or when Americal Colloid Company Bentonite −325 is used similar desirable results are obtained, with the bentonite agglomerates being craggy in appearance, containing depressions and fissures like those of the agglomerates in the drawing, of comparatively high bulk density, good frangibility, and non-segregating in detergent compositions like those of Example 2. Similarly, when in place of the sodium silicate employed, sodium silicates of other $Na_2O:SiO_2$ ratios within the range of 1:2 to 1:3 are used, good agglomeration and strong, non-dusting bentonite agglomerate particles result. This is also the case when instead of some of the sodium silicate, e.g., up to 50% thereof, other binders are employed, such as hydroxypropylmethyl cellulose, sodium alginate, sodium carboxymethylcellulose, polyvinyl alcohol and carrageenan. While best results are obtained with the spray concentrations of binder mentioned, other concentrations within the range of 6 to 9%, depositing 2 to 4% thereof in the final bentonite agglomerate, also result in acceptable product. Instead of using the O'Brien agglomerator, an inclined tumbling drum equipped with spray devices may be utilized and instead of a single spray, multiple sprays, along the length of the drum may be employed. While it is desirable for the silicate solution to be heated before spraying it is possible to make an acceptable product using a room temperature spray. Similarly, variations in nozzle types, pressures and agglomerating times may be made within the limits previously given and the products resulting will be satisfactory. It is possible to mix other materials with the bentonite and make coagglomerates but this is normally not desirable because one of the advantages of the invention is to be able to utilize the bentonite along as a fabric softening additive to other detergent compositions without the need to carry along with it possibly interfering components or ones that are undesirable in the particular final formulations to be made. The small proportion of silicate and/or other binder present is non-interfering with almost all detergent compositions and so is not objectionable.

EXAMPLE 4

When changes are made in the detergent composition formula of Example 2 and when the proportions of bentonite agglomerate in such formulas are varied within the limits previously set forth in the specification satisfactory products are also obtainable. Thus, when the specific alkyl sulfate, ethoxylated fatty alcohol sulfate, olefin sulfonate and/or paraffin sulfonate are employed instead of the tridecylbenzene sulfonate of Example 2 and when other alkylbenzene sulfonates are utilized, such as sodium linear dodecylbenzene sulfonate, good softening detergents are obainable. This is also the case when zeolite 4A is substituted for half of the sodium tripolyphosphate and when sodium bicarbonate is substituted for half of the sodium carbonate in the formula. Additionally, enzymes and bleaching agents may be post-added, and satisfactory products result. Also, when NTA replaces the sodium tripolyphosphate a useful product can be made by employing the bentonite agglomerates of this invention. Other non-phosphate detergents may be made, utilizing base beads such as those made by spray drying an aqueous crutcher mix comprising sodium carbonate and sodium bicarbonate, sometimes with additional sodium sulfate, and post-spraying with nonionic detergent. Such base beads may also include zeolite. For example, they may comprise about 35% of sodium carbonate, 25% of sodium bicarbonate, 30% of zeolite 4A and 10% of moisture, not to mention minor components. 80 Parts of such beads may then be sprayed with 20 parts of Neodol 23-6.5 or other suitable nonionic detergent and the resulting detergent composition, in particulate form, may be mixed with the agglomerated bentonite particles of this invention in the proportion described and by the method illustrated in Example 2 and elsewhere in this specification. The products resulting will also be satisfactory softening detergents of the desirable properties mentioned with respect to the product of Example 2. Similarly, changes may be made in the processing methods, proportions, temperatures, pressures, rates, times and speeds, within the limits given in the specification, to produce desired products of favorable characteristics. Of course, one of skill in the art will appreciate the interrelationships of such variables and will control them accordingly, to obtain desirable results.

The invention has been described with respect to examples and illustrations thereof but is not to be limited to these because it is evident that one of skill in the art, with this specification before him, will be able to utilize equivalents and substitutes without departing from the invention.

What is claimed is:

1. A process for manufacturing bentonite in particulate form, suitable for mixing with particulate detergent compositions so as to impart fabric softening properties to such compositions, which bentonite particles are agglomerates of finely divided bentonite, which comprises agglomerating finely divided bentonite particles, of sizes less than No. 325 sieve, U.S. Sieve Series, to bentonite particles which are irregular in shape and craggy in appearance, of sizes essentially in the No's. 10–100 sieves range, of a bulk density in the range of 0.7 to 0.9 g./ml., a moisture content of 11 to 13%, and a frangibility of less than 30, by continuously moving a mass of finely divided bentonite particles, of sizes less than No. 325 sieve, in an agglomerating apparatus, spraying moving surfaces of a curtain of the finely divided bentonite particles of the moving mass thereof with an aqueous solution of sodium silicate, which is of a concentration in the range of 2 to 20%, and which is at a temperature in the range of 65° to 85° C., with the amount of such sodium silicate solution sprayed being such as to have the final dried agglomerated bentonite particles of this process contain in the range of about 2 to 4% of sodium silicate, and keeping the finely divided mass of bentonite and resulting agglomerate particles of bentonite in motion until a major proportion of the mass is in the form of agglomerated particles which are irregular in shape and craggy in appearance, of sizes in the range of No's. 10-100 sieves, and of a moisture content of in the range of 23 to 31%, and drying the moistened and agglomerated particles to a moisture content in the range of 11 to 13%.

2. A process according to claim 1 wherein the sodium silicate is of $Na_2O:SiO_2$ ratio in the range of 1:2 to 1:3, the concentration of the sodium silicate in the aqueous solution sprayed is from 4 to 10%, the temperature of the sodium silicate solution immediately prior to spraying is in the range of 65° to 75° C., and spraying is through a nozzle of equivalent orifice diameter in the range of 0.05 to 0.1 mm. at a pressure in the range of 0.5 to 20 kg./sq. cm.

3. A process according to claim 2 wherein the sodium silicate is of $Na_2O:SiO_2$ ratio of about 1:2.4, the concentration of the sodium silicate in the aqueous solution is 6 to 9%, the temperature of the aqueous solution is about 70° C., the aqueous solution contains from 0.05 to 2% of water soluble dye and/or water dispersible pigment coloring agent, the amount of the aqueous solution sprayed is such as to raise the silicate content of the final dried agglomerated particles to about 3%, the agglomerating is conducted in an agglomerating apparatus equipped with longitudinal lifting rods, the spraying is through a nozzle equipped with a tip which produces a flat spray of an angle between 40° and 120°, which spray is directed across a falling screen of particles to be agglomerated, and the drying of the moistened and agglomerated particles is to a moisture content of about 12%, after which the agglomerated particles are screened to remove those that pass through a No. 100 sieve and those that fail to pass through a No. 40 sieve.

4. A process according to claim 2 wherein the sodium silicate is of $Na_2O:SiO_2$ ratio of about 1:2.4, the concentration of the sodium silicate in the aqueous solution sprayed onto the bentonite is about 7%, the temperature of such solution immediately prior to spraying is about 66° C., the spray nozzle is one of equivalent orifice diameter of about 0.9 mm. which sprays an essentially flat spray across the width of the mass of moving bentonite powder, and the spray pressure is in the range of 1.4 to 5 kg./sq. cm.

5. A process according to claim 1 wherein the particulate bentonite agglomerate of such process consists of bentonite, sodium silicate and water.

* * * * *